US005660506A

United States Patent [19]

Berge et al.

[11] Patent Number: 5,660,506

[45] Date of Patent: Aug. 26, 1997

[54] PNEUMATIC APPARATUS AND METHOD FOR CONVEYANCE OF FROZEN FOOD ITEMS

[75] Inventors: Jon Eric Berge, Irvine; Glenn Scott Seamark, Lake Forest, both of Calif.

[73] Assignee: D&B Supply Corp., Orange, Calif.

[21] Appl. No.: 383,444

[22] Filed: Feb. 3, 1995

[51] Int. Cl.[6] ..... B65G 53/08

[52] U.S. Cl. ..... 406/3; 406/33; 406/56; 406/144; 406/191

[58] Field of Search ..... 406/3, 33, 53, 406/56, 122, 144, 191

[56] References Cited

U.S. PATENT DOCUMENTS

| | | | |
|---|---|---|---|
| 2,391,863 | 1/1946 | Bowen | 406/144 |
| 2,975,000 | 3/1961 | Davis | 406/144 |
| 3,580,416 | 5/1971 | Hoenisch | 221/203 |
| 3,877,241 | 4/1975 | Wade | 62/137 |
| 3,930,377 | 1/1976 | Utter | 406/191 |
| 4,104,889 | 8/1978 | Hoenisch | 406/156 |
| 4,158,426 | 6/1979 | Frohbieter | 222/1 |
| 5,354,152 | 10/1994 | Reinhardt et al. | 406/3 |

OTHER PUBLICATIONS

"It's a Breeze . . . " Iceflow Systems Brochure, McCann's Engrg. & Mfg. Co. ©1995 [1995] *.

*Primary Examiner*—Gary C. Hoge

*Attorney, Agent, or Firm*—Brown, Martin, Haller & McClain

[57] ABSTRACT

Pneumatic conveying apparatus and method are described to provide for a simple, economical, convenient (and preferably automatic) system for conveying small pieces of frozen food (e.g., chopped vegetables, diced meat, or preferably ice cubes or crushed ice) on an as-required basis to one or more locations remote from a food source. The system is configured such that dispensing locations can be added or eliminated from the system or temporarily taken "off line" from the system without the need to change the basic system configuration or the central food providing apparatus. The apparatus includes a food source, a feed auger (preferably reversible) for moving the food from the source into the conveying conduit, use of pressurized air to convey the food through the conduit, and a receiver bin in the terminal container to collect the conveyed food for subsequent dispensing or use. Appropriate sensors and controllers, which may be microprocessor-based, may be used to automate the system. The conduit may be refrigerated and the entire system is easily cleanable. The system is used by restaurants, groceries, hotels and motels, hospitals, laboratories, and similar establishments for providing ice or other frozen food supplies at various locations. An important application of the system is for providing ice cubes from an ice maker to dispensers such as typical beverage/ice dispensers in fast food restaurants.

41 Claims, 1 Drawing Sheet

PNEUMATIC APPARATUS AND METHOD FOR CONVEYANCE OF FROZEN FOOD ITEMS

BACKGROUND OF THE INVENTION

1. Field of the Invention

The invention herein relates to pneumatic conveyor systems. More particularly it relates to a pneumatic conveyor system for the rapid and efficient conveyance of ice and similar small frozen food items.

2. Description of the Prior Art

In many commercial establishments there are ice dispensers from which patrons, employees or both can collect ice pieces (such as ice cubes) for chilling beverages or for other purposes. Among the most common examples of such establishments are the "fast food" restaurants. In a typical fast food restaurant there will be a single large ice making machine in the kitchen area which manufactures large quantities of ice cubes. In the food serving area (behind the counter) and/or in the customer service area (in front of the counter) there will be at least one and usually several beverage and ice dispensing machines. Those behind the counter will be utilized by the serving staff to prepare iced beverages for window service to drive-up patrons or for counter service, while those in the customer service area will be used directly by the patrons. Commonly a patron will order and receive his or her food tray along with an empty beverage cup at the counter. The patron will then take the empty cup and food to a nearby beverage and ice dispenser, fill the cup with ice and a beverage, and then take the food and the chilled beverage to the dining area.

Such beverage and ice dispensing machines do not normally manufacture ice. Rather, each contains an internal bin which holds a limited quantity of ice cubes. The ice cubes can be dispensed from the bin by the patron's manipulation of a lever or other control which opens a dispensing chute and allows a predetermined quantity of ice to fall into the patron's cup which is held below the discharge end of the chute. It will be readily appreciated that during busy times of the day, such as meal hours, a large number of patrons and/or the service staff will be using such dispensing devices and the ice bins in the dispensers will frequently run out of ice. When this happens with a patron-area dispenser the patrons will be understandably annoyed. When it happens with a dispenser used by the serving staff, service to drive-up and counter patrons will be impeded and such patrons will become annoyed by having to wait for long periods of time to receive their beverages. To avoid this problem, such restaurants commonly assign an employee to monitor the ice and beverage dispensers and to keep the ice bins adequately full by periodically hand-carrying quantities of ice from the ice making machine in the kitchen to the dispensing machines. However, for many reasons such periodic manual refilling of the ice bins often does not get accomplished; the assigned employee may be busy at other tasks or may be forgetful, the restaurant may be especially crowded and busy, patrons may be dispensing ice in larger quantities or more rapidly than anticipated, and so forth. Whatever the cause, the failure of the restaurant to provide adequate quantities of ice upon patrons' demand is a constant and real source of customer dissatisfaction.

Other establishments also need effective ice manufacture and distribution. Many restaurants other than fast food restaurants have salad bars, seafood bars, smorgasbords, dessert bars and the like where food must be kept chilled on beds of ice. Since the ice beds are exposed to the restaurants' normal room temperatures, the ice rapidly melts and must be periodically replenished. Similarly, cafeterias routinely place plates of salads and desserts, containers of beverages, and similar foods on beds of ice to stay chilled until selection by patrons. Again the ice beds rapidly melt and must be replenished. The same is true of supermarkets, grocery stores, and meat and fish markets, where many fresh vegetables and especially meats and seafood are displayed on beds of ice to keep them chilled.

Outside the restaurant, grocery and food service fields, hotels and motels provide ice vending machines available to guests so that the guests can fill room ice buckets and have ice available for beverages in their own rooms. In the hotel/motel setting the vending device will be an actual ice maker, similar to the one used in a restaurant kitchen. However, since a number of such ice makers are needed to server guests throughout the facility, the overall cost is high. Therefore hotels and motels seek to minimize the number of such machines they have on the premises while yet providing a sufficient quantity of ice available to satisfy guests' demands. However, because the number of machines is kept to a minimum, many guests find that the location of the closest ice machine is inconvenient to their rooms. Conversely, those whose rooms are close to the ice making machines frequently complain about the traffic and noise associated with other guests coming to obtain ice.

Further, ice is commonly used in hospitals for a number of purposes, including providing chilled beverages to patients and staff and filling ice packs for patient treatment. As with hotels and motels, hospitals normally use ice making machines, but again because of the cost the number of such machines is kept to a minimum consistent with patient service and care. However, because of the minimum number of machines, frequently hospital staff find that they must walk long distances to obtain ice from the closest vending machine, extending the time away from their assigned posts.

Transport of small frozen food items other than ice is also important in many instances. For instance, in food processing plants many products are composed of small food items such as corn kernels, peas, small pieces of meat, etc. Prepared soups, stews and similar products are examples of composite foods which use many such small food items. Such products are usually formed by collecting the food items in already frozen form, or by collecting and cooking some or all of the small items and then freezing them. (In either case, the purchaser buys the composite food product as frozen and then thaws and cooks it at home.) The small frozen food items are currently transported at the food processing plant by being place in large wheeled containers, manually pushed to the desired location for cooking, packaging, etc., and then hand-dumped into the appropriate packaging device, cooking kettle, etc.

Manual transport and replenishment of ice or food items are often unsanitary and unsafe. Such introduces the real possibility of contamination of the ice or food, since the person handling the ice or food may be ill or dirty, or the ice or food, while open to the ambient atmosphere, may come into contact with bacteria, dirt, or other contaminants. Ice frequently spills while being transported, and if not promptly cleaned up will melt, causing dangerously slippery floors. Also, manually moving ice can cause injury to the workers, such as back injuries from lifting heavy containers of ice or injuries from falling while attempting to dump the ice into the dispensers (which are normally elevated).

The present invention overcomes these problems, and fills a long-felt need for convenient, economical and, optionally, automatic conveyance and provision of ice and other small frozen food items.

Only one other ice conveyance system incorporating pneumatic technology has been described. Ice Flow Systems of Ireland markets a system which is much more technically complex, expensive and susceptible to malfunction than the system of this invention. It is believed that the Irish system has not received approval in the United States from the National Sanitation Foundation.

SUMMARY OF THE INVENTION

The apparatus and method described and claimed as the present invention provide for a simple, economical and convenient system for conveying frozen food pieces on an as-required basis to one or more locations remote from a supply source. It is most widely useful for conveyance of ice, but will also have application with other frozen food items. The system uses safe and convenient pneumatic conveying technology, and can be configured to convey the frozen food items automatically to the dispensing or end use locations to maintain adequate quantities of the items on hand at such locations at all times. Hand carrying or trucking of quantities of the frozen food items to fill storage, processing or dispenser bins is eliminated.

For ice handling systems, the invention is designed to convey ice pieces to selected remote locations and keep adequate supplies of ice on hand at those locations for dispensing to restaurant patrons and employees, hotel and motel guests, hospital staff and others similarly situated. The system can be arranged with a central ice making machine in a location readily available for service but where it does not interfere with establishment operations, patrons or employees, and the ice can be readily conveyed to dispensing machines which are conveniently located for use by establishment patrons and employees. Since dispensing devices are less costly than ice making devices, an optimum number of dispensing devices can be placed at various convenient locations. The system can also be configured such that additional dispensing locations can subsequently be added or under-utilized ones can be eliminated from the system without the need to change the basic system configuration or the central ice making apparatus. Further, the ice making machine itself can be placed in its own enclosure or room, out of the way of workers. This isolates the noise of the machine from working areas or patron areas. It also allows the machine to work efficiently and saves on energy costs, since the heat generated by the machine can be isolated and does not add to the cooling load in adjacent working or dining areas.

The present system also has the capability of being readily cleanable, which is of course very important when ice or food items are to be conveyed. This has not been possible in the past, since prior art conveying systems cannot be cleaned without significant disassembly. Further, the unique capability of the present system to include chilled conveying lines results in efficient transport of the frozen items with no significant thawing in transit.

In its basic apparatus aspect, the invention involves apparatus for conveying frozen food items from a source to a remotely located container, which comprises: a source for the production of a plurality of pieces of frozen food, each such piece having physical characteristics amenable to transport by pneumatic conveyance; a hollow elongated conduit having an inlet end and an outlet end; feed means for discharging such pieces of frozen food from the source and introducing them into the conduit through a food inlet at the inlet end; gas pressure means for introducing a moving stream of pressurized gas into the conduit through a gas inlet at the inlet end, the pressurized gas mixing in the conduit with the introduced pieces of food and motion of the stream of gas through the conduit conveying the pieces of food through the conduit and discharging them through the outlet end; and receiver means associated with the remote container for receiving the discharged pieces of food from the conduit and retaining them in the container for subsequent dispensing or use.

In its basic method aspect, the invention involves a method for conveyance of frozen food items from a source to a remote located container, which comprises: producing a plurality of pieces of food in such source, each such piece of food having physical characteristics amenable to transport by pneumatic conveyance; discharging the pieces of food from the source and introducing them into a hollow elongated conduit having an inlet end and an outlet end through a food inlet at the inlet end; introducing a moving stream of pressurized gas into the conduit through a gas inlet at the inlet end; mixing the pressurized gas in the conduit with the introduced pieces of food; moving the stream of gas through the conduit and thereby conveying the pieces of food through the conduit and discharging them through the outlet end; and receiving the discharged pieces of food in a receiver associated with the remotely located container from the conduit and retaining them in the container for subsequent dispensing or use.

In particularly preferred embodiments, the food will be ice and the gas will be air.

These and other embodiments, aspects, applications and variations of the invention will be described below, with particular reference to the accompanying Figures of the drawings.

DETAILED DESCRIPTION AND PREFERRED EMBODIMENTS

For purposes herein, the "pieces" of food which are conveyed will frequently be exemplified and referred to simply as "ice cubes," since the most common application of the invention is expected to be for ice conveyance. It will be understood, however, that the system is intended to be used with any size or configuration of small frozen food items or "pieces," subject only to the limitation that such pieces must be amenable to pneumatic conveyance through the system. A more detailed description of suitable physical properties and representative food types will be presented below. It will also be understood that, as to ice itself, the term "ice cubes" is not to be restricted solely to ice pieces of essentially cubical shape, but will include ice pieces which have other substantially regular shapes such as half moons, crescents, cylinders, disks and various solid polygons. It is also intended to include pieces with irregular shapes, such as those formed by crushing, fragmenting, chipping or otherwise comminuting large solid blocks of ice into the irregular chunks sold commercially under terms such as "crushed ice." Thus, while the term "ice cubes" will be used below for convenience, it will be understood that the invention herein is applicable to all forms and sizes of pneumatically conveyable ice pieces.

Figure 1:
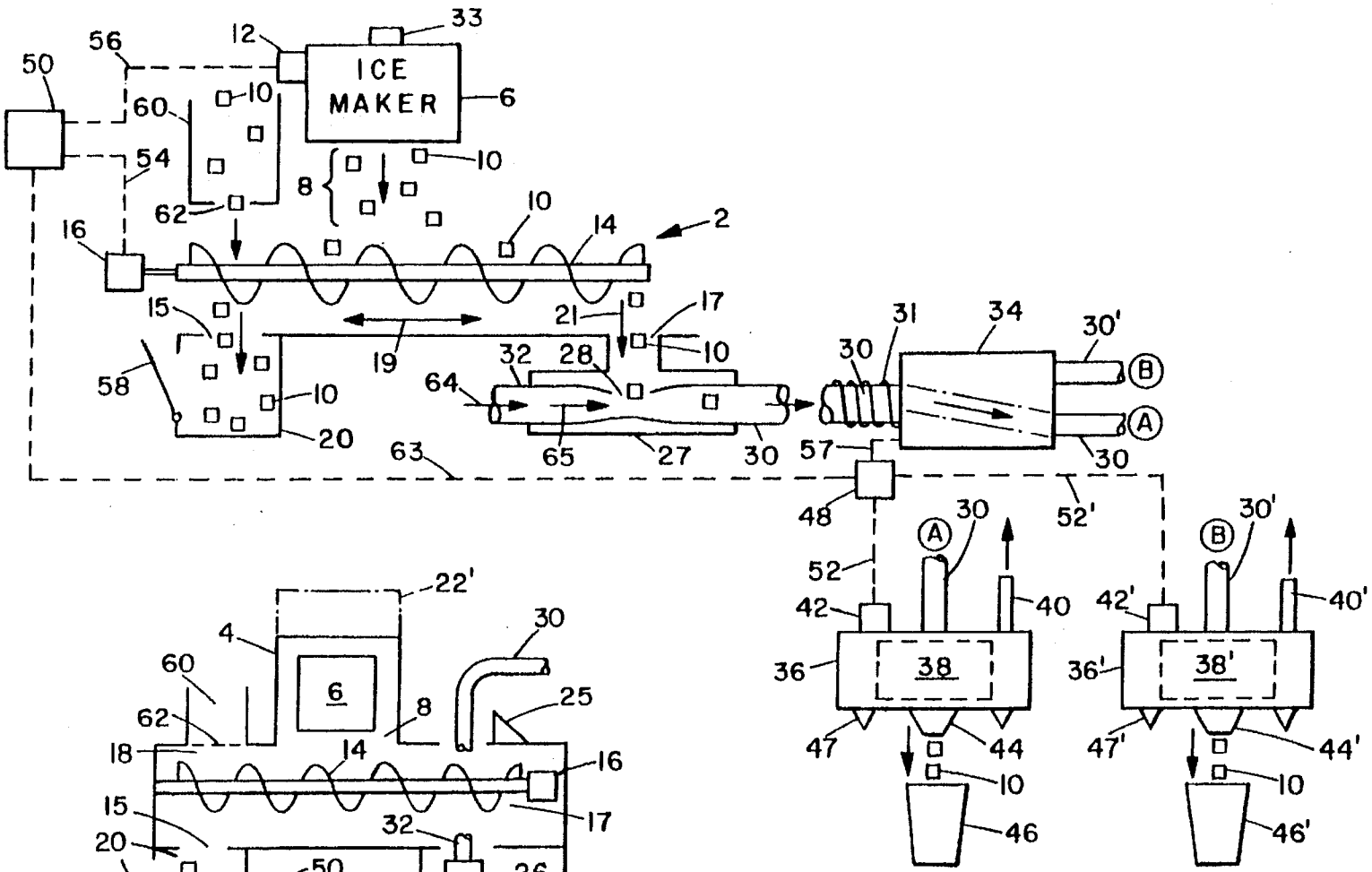
FIG. 1 is a schematic diagram illustrating the major components of the system and the movement of an exemplary food product, i.e., ice cubes, through the system from the ice making equipment to dispensing to the consumer.
Figure 2:
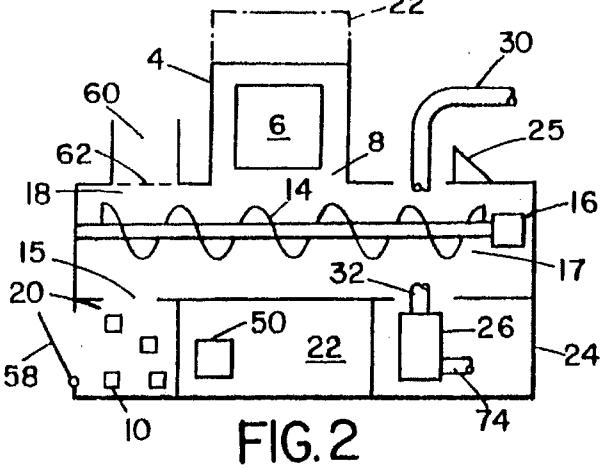
FIG. 2 is a diagrammatic side elevation view of typical ice making equipment useful in the present invention, showing means for transport of the formed ice cubes into the conveying system.

The invention will be best understood by reference to the drawings, in which the invention is exemplified by an ice making, conveying and dispensing system. In FIG. 1 the overall system 2 is illustrated. An ice making device 6 is enclosed in a housing 4. Much of the ice making equipment, such as the refrigerant compressor and condenser and control equipment may conveniently be contained in chamber 22, which may be the bottom of housing 4 or alternatively at a different location, as at the top of housing 4 (indicated at 22'). The particular type of ice making device 6 is not critical. Many devices are commercially available from a number of manufacturers in a wide range of sizes and capacities, and at various costs, and will be quite suitable. Typical examples are those available commercially from Ice-O-Matic and Scottsman companies. In such devices ice cubes are commonly formed by flowing water into individual molds, each of the appropriate size for a single ice cube, and then freezing the water to form the solid cubes. Once the ice cubes are frozen, the individual cubes 10 are ejected from the ice maker 6 for collection.

The ejected cubes 10 fall from the ice maker 6 into reversible auger 14. A small zone 8 between the ice maker 6 and auger 14 allows space for accumulation of cubes 10 as they are fed into the auger 14. Auger 14 operates in a zone 18 which has outlets 15 and 17 at its opposite ends. The direction of auger travel is controlled by reversible drive motor 16 as indicated by arrow 19. When the system is operating to convey ice to the remote dispensers, the auger 14 will be run to move ice 10 toward the outlet 17; operation in the reversed mode will be described below. The speed of the auger 14 is selected to move accumulated ice from zone 8 out of the ice machine through outlet 17 from which the ice cubes pass seriatim into the receiving chamber 27 of the pneumatic conveying system. Maintaining the one-by-one order of the cubes entering the conveying system (as indicated by arrow 21) is important since it permits dependable conveyance of the ice cubes with minimal opportunity for ice jams to occur in the system.

The hollow conveying pipe or conduit 30 has at its inlet end the receiving chamber 27 into which the ice cubes 10 are received from auger outlet 17 and also a gas inlet 32. The gas and ice inlet paths meet in the chamber 27. Gas under pressure is supplied to inlet 32 from a source as indicated by arrow 64. The source of the pressurized gas may be a compressor or pump 26 drawing in ambient gas through inlet 74 or it may be bottled gas. Normally the gas will simply be ambient air, although under appropriate circumstances inert gases such as nitrogen or argon may be used to convey the ice. (For the purposes of the discussion herein it will be assumed that the gas is air.) A preferred pump 26 is a Blovac™ air pump commercially available from Blovac Pneumatics Pty. Ltd. Upon entering the inlet 32 the pressurized air forms a moving air stream 65 which comes into contact with the ice cubes 10 in zone 28. Zone 28 will preferably be in the form of a venturi or similar gas/solid mixing device as indicated in FIG. 1. Use of a venturi increases efficiency in that it causes the ice cubes 10 to be drawn into the air stream 65 by a vacuum effect. The movement of the air stream 65 is sufficient to entrain the ice cubes 10 and move them at the desired speed along through the hollow conduit 30. Gas pressures in the range of about 30–150 psi (205–1035 kPa), preferably about 60–100 psi (415–690 kPa), and gas flow rates of about 10–50 $ft^3$/sec (280–1410 l/sec), preferably about 30–40 $ft^3$/sec (850–1130 l/sec), will be quite suitable for conveyance of the common ice cube sizes in the present system, although it will be understood that the optimum operating gas pressure and flow rate will be dependent upon the configuration of the system, the length of travel of the ice, the conduit size and condition, and other factors analogous to operation of pneumatic conveying systems for other objects and materials. Those skilled in the art will have no difficulty determining the optimum parameters for any given system.

The air compressor 26, auger motor 16 and related equipment may conveniently be housed in an extension housing 24 attached to housing 4. A control panel 25 for the system may be conveniently mounted on the extension housing 24, from which the system can be monitored (and if necessary, manually controlled) by an operator. The control panel 25 may contain not only the operational controls for the system 2 but also read-out devices to indicate to the operator such useful information as how full each of the various remote bins 38 is, whether the system is in the ice conveying mode or in a "stand-by" or "by-pass" mode, which dispensers are on-line, and so forth.

In many configurations of the present invention the conduit 30 will be a single conduit and be routed directly to a single dispensing device 36 in which the conveyed ice exits from the conduit 30 directly into the ice bin 38 in the dispenser 36. A vent 40 is provided in each dispenser 36 or near the discharge end of conduit 30 to vent the high pressure air. If there is more than one dispenser 36, the conduit 30 can be divided at some intermediate point along its length into a appropriate number of separate conduits (indicated as 30 and 30'). A diverter 34 is used to route the ice cubes from the conduit 30 into the appropriate branch 30 or 30' and on to the desired dispenser 36 or 36'. It is possible that sequential branching and diverters may be present. Diverters are well known in the pneumatic conveying industry and are available from a number of sources. Typical commercial diverters will provide for routing among two to four or more branches. A particularly preferred diverter is commercially available from Air Link International of Orange, Calif., and provides for diversion of the conveying stream into any one of two to six branches in a rapid and easily controlled manner.

(It will be understood that the primed numerals in FIG. 1 represent additional but equivalent conduits, dispensers and their functions and components. Therefore for brevity herein only the unprimed numeral will usually be cited, and the reader will understand that the same statements apply to the primed numerals for the additional conduits and dispensers. Where distinction between primed and unprimed numerals and their indicated components is significant, both will be cited.)

Use of a diverter 34 also allows for the system to be conveniently reconfigured when desired. New branches can be joined to the outlet end of the diverter 34 (up to its maximum capacity), or one or more branches 30 or 30' can itself be branched with an additional diverter, without disturbing the rest of the system. Similarly, a branch 30 or 30' can be eliminated if its dispenser is under-utilized, simply by disconnecting it from the diverter 34 and sealing the respective outlet port of the diverter. Further, short of reconfiguring, one may incorporate a shut-off valve in one or more of the branches so that a branch can be temporarily taken out of the "on-line" system, such as for repairs or maintenance of the branch or its dispenser, without affecting the other branches and without actually removing the branch from the system.

The ice cubes 10 which are deposited in the bin 38 of dispenser 36 can be accessed and dispensed through chute 44 into a beverage container 46 or into any other convenient container, such as a hotel ice bucket. In some cases, particularly in fast food restaurants, the ice dispenser 36 will also provide for dispensing of beverages through nozzles 47. Commercial ice/beverage dispensers which can be adapted for use in the present invention are available from sources such as Remcor Company and Follett Corporation.

It is preferred to provide for automatic filling of the dispensers 36. To this end the ice bin 38 or 38' of each dispenser 36 or 36' will be equipped with a sensor 42 or 42' which measures the quantity of ice present in the bin 38 or 38'. Such sensors may be mechanical and operate by, for instance, having an easily moved lever arm which is displaced as the quantity of ice increases or decreases within the bin 38, with the position of the lever arm at any time determining the quantity of ice present. Alternatively, such sensors may be electromechanical and, for instance, determine the quantity of ice present by its weight through use of one or more strain gauges placed on the bottom or sides of the bin, or by connection to a scale balance. A signal which communicates the quantity of ice present is generated by the sensor 42, either continually or intermittently, and conveyed through cable 52 to system controller 48. Controller 48 is preset or programmed with data identifying the maximum and minimum quantities of ice to be kept in the bin 38 of each dispenser 36. The signals generated by the individual sensors 42 or 42' on the different dispensers 36 and 36' will be coded or otherwise identifiable by the controller 48 as to which of the dispensers 36 or 36' the signal is coming from. When the controller 48 determines from a received signal that the ice quantity in a particular bin 38 has reached the minimum allowable level, it generates a second signal which is sent through cable 63 to ice machine controller 50 which operates the ice making, transport and conveying equipment. Controller 50 activates the motor 16 of auger 14 through cable 54 and the off/on switch 12 of ice making equipment device 6 through cable 56 to cause the ice machine 4 to form additional ice cubes 10 and dispense them from the ice maker 6 to the auger 14. It also starts the air pressurization source and causes the pressurized air to the fed into the conveyance system so that the produced ice cubes 10 will be conveyed to the particular ice bin 38 in which the ice supply has become depleted. Separately, controller 48 will operate the diverter 34 through cable 57 (in multi-branch systems) to make the diverter 34 route the ice cubes 10 through the appropriate conduit branch 30 or 30' to the target dispenser 36 or 36'.

In a single dispenser system, when controller 48 receives a signal from the sensor 42 indicating that the bin 38 of the dispenser 36 has reached its maximum allowable capacity of ice, the controller 48 sends a signal to controller 50 to stop insertion of ice into the conveying system and to shut off the conveying system to keep the bin 38 from overflowing. In most systems, where there are a number of different dispensers 36 and 36' on the system, the system may be run by controllers 48 and 50 on a wide variety of schedules, utilizing diverter 34 to route ice to the different bins 38 and 38' on an as-needed basis. Thus some heavily used dispensers can be replenished with ice cubes 10 more frequently than lesser used dispensers.

Sensors 42 and controllers 48 and 50 may, if desired, be microprocessor-based.

It will be evident that these operations can be conducted automatically, so that ice is essentially always adequately available without intervention or action by establishment employees. Ice bins 38 can thus be refilled to maximum levels automatically during periods of low usage (such as at night) whether or not establishment employees are present. It is possible, however, that in some periods of extremely heavy use (such as a peak meal hour at a fast food restaurant) the patron demand for ice will be cause ice to be drawn from dispenser 36 at a faster rate than ice maker 6 can produce ice cubes 10. To avoid depletion of ice in the bin 38 the system preferably provides for temporary manual insertion of ice cubes 10 (from a source other than ice maker 6; commonly bin 20) into the auger 14 from feeder 60 through entry 62. The auger 14 will then transport the inserted ice for entry into the conduit 30 and conveyance to the dispenser 36 in the normal manner. This capability also allows the system to continue to function if the ice maker 6 fails for some reason.

In an alternative "stand by" or "by-pass" mode when ice conveyance is not desired but neither is it desired to shut down the ice making equipment, the ice maker 6 may be operated on an essentially continuous basis or according to a normal timed cycle. In this case the auger 14 will be operated in the reverse direction to move ice through outlet 15 to container bin 20. Bin 20 can be accessed manually through door 58 to retrieve the ice 10 accumulated in bin 20. This accumulated ice 10 in bin 20 if also the preferred source of ice for the manual insertion of ice into the system through feeder 60 as discussed above. Normally this alternative mode will be used at night or during slack periods when the dispensers 36 are full, so that a reserve supply of ice can be accumulated in bin 20.

The system can include many conventional commercial parts, such as the ice making equipment, auger, pneumatic conveying conduit and diverter. Also, the units 36 may be conventional beverage and ice dispensers which are simply adapted to receive the conveyed ice into their internal collection bins 38 from the conduits 30 and to vent the air pressure through the vents 40. The sensors 42 are desirable and preferred, but it would be also possible for an operator (such as a restaurant employee), to periodically monitor the bins 38 to visually observe the quantity of ice and then control the system manually by the controls on panel 25 on the ice making machine. Of course, the automatic operation with the sensors 42 and the controllers 48 and 50 is to be preferred, since the system then does not need the visual observation and control of any person and thus avoids problems of overfilling or emptying of the ice bins if the assigned employee is unobservant or becomes preoccupied with other duties. However, it is also desirable to provide for manual monitoring and operation, for convenient access to the various components of the system when the system is off-line, such as for maintenance.

The conduit 30 itself may be of any convenient length along which the ice can be conveyed without significant damage to or melting of the cubes 10. A typical maximum length will be approximately 100 ft (30 m) from the mixing chamber 27 to the farthest dispenser bin 38. Longer conduits may be used, but will require supplement compressed air suppliers along the line, such as additional Blovac™ pumps spaced at appropriate intervals throughout the system. Normal size conveying conduits may be used, which will generally have inside diameters in the range of 2–6 in (5–15 cm). They will of course have walls of sufficient thickness to withstand the internal air pressure and air flow stream. It is also advantageous to encase the main conduit 30 and branches 30' in thermal insulation and/or to refrigerate the conduits as through refrigerator coils 31 to approximately 25°–38° F. (–4° to +3° C.), preferably 33°–36° F. (0.5°–2° C.). This will insure that melting of the ice (or other conveyed frozen food) is minimal or essentially nonexistent and that there will be no bacterial growth. Equipment for this purpose is commercially available from Multiplex Corporation.

In some ice distribution systems which are in parallel with beverage distribution and replenishment systems such as in fast food restaurants or bars, it may be desirable to group beverage and ice supply conduits into a single bundle running from the ice and beverage supply sources in the restaurant's kitchen area to each of the beverage/ice dispensers 36 behind or in front of the service counter. Beverage and ice conduits can be sized such that all will fit within a 6 in (15 cm) insulated duct.

The system can be fitted with a chemical cleaning system 33 from which a liquid solution of one or more cleaning chemicals is blown through the system by the pressurized air periodically. Suitable chemicals which clean and sanitize the system may be chosen from those approved for incidental food contact; typical examples are various types of chlorine bleaches. This cleaning operation can extend throughout the entire apparatus, including the ice maker and auger, by using the suction of the compressed air system to draw the liquid cleaner in through the ice maker 6 and through the auger 14 and then by pressure move the cleaner on through the rest of the system 2 and out through a discharge port such as chute 44 or vent 40 or other drain commonly found on commercial ice dispensing devices. This has the advantage that the entire system can be cleaned without having to disassemble any of the components. By running the air for a short time after the last of the liquid cleaner has been added and transported, one can also assure that the system will be thoroughly dried so that no residual liquid remains.

The system may be constructed of any convenient materials which commonly are used to contain ice and which are approved for contact with foods. Such materials include stainless steels and similar metals as well as some high strength plastics. Optionally one may coat the inner surface of the conduit 30 and the diverter 34 with a friction reducing material such as a PTFE polymer to reduce the friction of the moving ice and also to reduce any tendency of the ice to adhere to the inside of the conduit or the diverter. As noted above, the ice cubes or pieces 10 may be of any size and shape which can be conveyed at a reasonable speed and without undue melting or damage through the conduit 30 by the air stream 65. In most cases, the ice cubes or pieces 10 will be solid bodies of generally equal or similar length, width and depth dimensions and having volumes of approximately 0.5–2.0 $in^3$ (8–32 $cm^3$), preferably about 1 $in^3$ (16 $cm^3$). (Since ice has a substantially constant density [$\rho \approx 1.0$], the weight of each cube 10 will be proportional to its volume.) The maximum and minimum ice sizes and shapes that can be conveyed within a given system by a particular level of air pressure and speed of airstream flow can be readily determined by those skilled in the art without any undue experimentation.

The various kinds of non-ice food items will have similar dimensions, consistent with their individual natures. Typical of the types of frozen food items or pieces are corn kernels, peas, beans or other chopped vegetables such as chopped carrots or broccoli; small cubed or diced pieces of meat, chicken or shellfish; frozen bread or cake cubes or pasta items such as macaroni; candies or garnishes; and the like. These can be conveyed in frozen form to mixing, cooking, baking, packaging or other types of food processing operations.

In addition to ice conveyance uses in the restaurant, hotel/motel and hospital industries, it will be recognized that there will be many applications of ice and other frozen food conveyance in food processing plants, cold storage facilities, scientific research laboratories and many other establishments. It is therefore to be understood that the present system is not to be considered to be specific solely to any one particular industry or type of facility or establishment, but may be conveniently used anywhere where ice or frozen food conveyance and/or maintenance of quantities of such items at remote locations from a source is either convenient or necessary.

It will be recognized that there are numerous embodiments of the present invention which, while not expressly described above, are clearly within the scope and spirit of the invention. The above description is therefore intended to be exemplary only, and the scope of the invention is to be limited solely by the appended claims.

We claim:

1. Apparatus for conveying small frozen food pieces from a source to a remote container, which comprises:

a source of a plurality of pieces of food;

a hollow elongated conduit extending from said source to said remote container and having an inlet end and an outlet end;

feed means for discharging pieces of food from said source and from which said pieces of food are introduced into said conduit through a food inlet at said inlet end, introduction being impelled by a stream of gas moving within said conduit, or alternately into a proximate container from which they can subsequently be retrieved for introduction into said conduit and conveyance to said remote container.

selection means to control whether said discharged pieces of food are introduced into said conduit or said proximate container;

gas pressure means for introducing said moving stream of pressurized gas into said conduit through a gas inlet at said inlet end, said pressurized gas mixing in said conduit with said introduced pieces of food and motion of said stream of gas through said conduit inducting said pieces of food into said conduit, conveying them through said conduit and discharging them through said outlet end; and receiver means associated with said remote container for receiving said discharged pieces of food from said conduit and retaining them in said remote container for subsequent dispensing or use.

2. Apparatus as in claim 1 wherein said gas is air.

3. Apparatus as in claim 1 wherein said pieces of food comprise pieces of vegetables, meats or ice.

4. Apparatus as in claim 3 wherein said pieces of food comprise pieces of ice.

5. Apparatus as in claim 4 wherein said feed means comprises an ice maker for freezing water to produce discrete pieces of ice, release means for releasing said pieces of ice from said ice maker, and an auger to transport said released pieces of ice to said food inlet of said conduit.

6. Apparatus as in claim 4 further comprising sensor means for determining the quantity of pieces of ice retained in said receiver means.

7. Apparatus as in claim 6 further comprising:

signal generation means operably associated with said sensor for generating a first signal when said sensor determines that said quantity of pieces of ice in said receiver means has reached a predetermined minimum level;

control means for activating said apparatus; and transmission means for transmitting said first signal to said control means to cause said control means to activate said apparatus to cause said ice maker to produce said pieces of ice and convey them to said receiver means.

8. Apparatus as in claim 7 wherein said signal generation means further generates a second signal when said sensor determines that said quantity of pieces of ice in said receiver means has reached a predetermined maximum level; and said second signal being transmitted by said transmission means to said control means to cause said control means to deactivate said apparatus and stop the production of pieces of ice and conveyance of them to said receiver means.

9. Apparatus as in claim 7 wherein said signal generation means further generates a second signal when said sensor determines that said quantity of pieces of ice in said receiver means has reached a predetermined maximum level; and said second signal being transmitted by said transmission means to said control means to cause said control means to change the routing of said discharged pieces of food and transport them to said proximate container instead of said conduit.

10. Apparatus as in claim 4 wherein said pieces of ice comprise ice cubes or crushed ice.

11. Apparatus as in claim 1 further comprising sensor means for determining the quantity of pieces of food retained in said receiver means.

12. Apparatus as in claim 11 further comprising:

signal generation means operably associated with said sensor for generating a first signal when said sensor determines that said quantity of pieces of food in said receiver means has reached a predetermined minimum level;

control means for activating said apparatus; and transmission means for transmitting said first signal to said control means to cause said control means to activate said apparatus to obtain said pieces of food from said source and convey them to said receiver means.

13. Apparatus as in claim 12 wherein said signal generation means further generates a second signal when said sensor determines that said quantity of pieces of food in said receiver means has reached a predetermined maximum level; and said second signal being transmitted by said transmission means to said control means to cause said control means to deactivate said apparatus and stop obtaining said pieces of food and conveying them to said receiver means.

14. Apparatus as in claim 1 comprising a plurality of said receiver means and said conduit having an intermediate division point from which a plurality of branch conduits extend, each branch conduit terminating in an outlet end at a respective one of said plurality of receiver means.

15. Apparatus as in claim 14 wherein said conduit comprises diverter means at said point of division for directing said stream of gas and said conveyed pieces of food into and through selected ones of said branch conduits.

16. Apparatus as in claim 1 wherein said gas inlet for said stream of gas in said conduit comprises a venturi in said conduit, said food inlet opens into the low pressure region of said venturi, and said pieces of food are drawn into said venturi by said moving stream of gas and are at least initially mixed with said stream of gas within said venturi.

17. Apparatus as in claim 1 wherein said feed means comprises an auger for transporting said discharged pieces of food from said source to said conduit.

18. Apparatus as in claim 17 wherein said auger is reversible and can be operated in reverse to transport said discharged pieces of food to said proximate container rather than to said conduit.

19. Apparatus as in claim 1 wherein said conduit is refrigerated.

20. Apparatus as in claim 1 further comprising cleaning means for introducing a cleaning composition into said apparatus, said gas pressure means for conveying said composition through said apparatus while said composition cleans said apparatus and discharge means for thereafter removing said composition.

21. A method for conveying small frozen food pieces from a source to a remote container, which comprises:

obtaining a plurality of pieces of food from said source;

introducing a moving Stream of pressurized gas into a hollow elongated conduit having an inlet end and an outlet end through a gas inlet at said inlet end;

providing a proximate container for temporary collection of said pieces of food from which they can subsequently be retrieved for transport to said remote container;

discharging said pieces of food from said source and selecting whether said pieces of food are routed to said conduit for transport to said remote container or to said proximate container;

for those pieces of food to be transported directly to said remote container, routing them to and introducing them into said conduit through a food inlet at said inlet end and impelling induction of said food pieces into said conduit by said moving stream of pressurized gas and mixing said pressurized gas in said conduit with said introduced pieces of food;

moving said stream of gas through said conduit thereby conveying said pieces of food through said conduit and discharging them through said outlet end; and receiving said discharged pieces of food in a receiver associated with said remote container from said conduit and retaining them in said remote container for subsequent dispensing or use.

22. A method as in claim 21 wherein said gas is air.

23. A method as in claim 21 wherein said pieces of food comprise pieces of vegetables, meats or ice.

24. A method as in claim 23 wherein said pieces of food comprise pieces of ice.

25. A method as in claim 24 wherein production of said pieces of ice comprises freezing water to produce discrete pieces of ice, releasing said pieces of ice from said ice maker, and transporting said released pieces of ice to said food inlet of said conduit.

26. A method as in claim 24 further comprising determining the quantity of pieces of ice retained in said receiver.

27. A method as in claim 26 further comprising:

determining when said quantity of pieces of ice in said receiver means has reached a predetermined minimum level and thereupon generating a first signal;

transmitting said first signal to said control means for said source to cause said control means to activate said ice maker to produce said pieces of ice; and conveying said pieces of ice to said receiver.

28. A method as in claim 26 further comprising:

determining when said quantity of pieces of ice in said receiver means has reached a predetermined maximum level and thereupon generating a second signal; and transmitting said second signal to said control means to cause said control means to deactivate said apparatus and stop obtaining said pieces of ice and conveying them to said receiver means.

29. A method as in claim 26 further comprising:

determining when said quantity of pieces of ice in said receiver means has reached a predetermined maximum level and thereupon generating a second signal; and transmitting said second signal to said control means to cause said control means to change the routing of said discharged pieces of food and transport them to said proximate container instead of said conduit.

30. A method as in claim 24 wherein there are a plurality of said receivers and said conduit having an intermediate division point from which a plurality of branch conduits extend, each branch conduit terminating in an outlet end at a respective one of said plurality of receiver, and wherein said method further comprises directing said stream of gas and said conveyed pieces of ice into and through selected ones of said branch conduits.

31. A method as in claim 24 wherein said gas inlet for said stream of gas in said conduit comprises a venturi in said conduit, said food inlet opens into the low pressure region of said venturi, and said method further comprises at least initially mixing said pieces of ice and stream of gas within said venturi.

32. A method as in claim 24 wherein said pieces of ice comprise ice cubes or crushed ice.

33. A method as in claim 21 further comprising determining the quantity of pieces of food retained in said receiver.

34. A method as in claim 33 further comprising:

determining when said quantity of pieces of food in said receiver means has reached a predetermined minimum level and thereupon generating a first signal;

transmitting said first signal to said control means for said source to cause said control means to activate said source to obtain said pieces of food from said source; and conveying said pieces of food to said receiver.

35. A method as in claim 33 further comprising:

determining when said quantity of pieces of food in said receiver means has reached a predetermined maximum level and thereupon generating a second signal; and transmitting said second signal to said control means to cause said control means to deactivate said apparatus and stop obtaining said pieces of food and conveying them to said receiver means.

36. A method as in claim 21 wherein there are a plurality of said receivers and said conduit having an intermediate division point from which a plurality of branch conduits extend, each branch conduit terminating in an outlet end at a respective one of said plurality of receiver, and wherein said method further comprises directing said stream of gas and said conveyed pieces of food into and through selected ones of said branch conduits.

37. A method as in claim 21 wherein said gas inlet for said stream of gas in said conduit comprises a venturi in said conduit, said food inlet opens into the low pressure region of said venturi, and said method further comprises using said stream of gas to induct said pieces of food into said conduit at said venturi and mixing said pieces of food and stream of gas within said venturi.

38. A method as in claim 21 wherein said pieces of food are discharged from said source into a reversible auger and said method comprises alternatively operating said auger in a forward direction to transport said pieces of food to said conduit or operating said auger in reverse to transport said discharged pieces of food to said proximate container rather than said conduit.

39. A method as in claim 21 further comprising refrigerating said conduit.

40. A method as in claim 21 further comprising introducing a cleaning composition, conveying said composition through said conduit while said composition cleans said conduit and thereafter removing said composition from said conduit.

41. A method as in claim 40 further comprising conveying said composition through from said source through said receiver and thereafter removing said composition.

* * * * *